United States Patent [19]

Elting

[11] 4,177,539

[45] Dec. 11, 1979

[54] OSCILLATING SOOT BLOWER MECHANISM

[76] Inventor: Larry M. Elting, 712 Madison Ave., Lancaster, Ohio 43130

[21] Appl. No.: 945,854

[22] Filed: Sep. 26, 1978

[51] Int. Cl.[2] ..... F23J 3/02

[52] U.S. Cl. ..... 15/316 R

[58] Field of Search ..... 15/316 R, 316 A, 317, 15/318

[56] References Cited

U.S. PATENT DOCUMENTS

| | | | |
|---|---|---|---|
| 3,230,568 | 1/1966 | Saltz | 15/317 |
| 3,377,026 | 4/1968 | DeMart et al. | 15/317 X |
| 3,439,376 | 4/1969 | Nelson et al. | 15/317 |
| 3,477,085 | 11/1969 | Dulait | 15/317 |

*Primary Examiner*—Christopher K. Moore
*Attorney, Agent, or Firm*—J. C. Evans

[57] ABSTRACT

An accessory transmission mechanism for causing the lance of a soot blower of the well-known IK long travel type to oscillate about its longitudinal axis, rather than rotating continuously in the conventional manner during its projecting travel and during its retracting travel, and which also drives the lance longitudinally, consists of a conversion transmission assembly adapted to be installed in the carriage of the blower. The conversion assembly includes a tubular idler shaft fitted on and rotatable independently of a solid inner shaft which is mounted in the blower carriage as a simple replacement for a corresondingly mounted shaft of the standard blower carriage. The tubular shaft drives a Scotch yoke mechanism and also drives the walking pinions which drive the carriage along the beam to actuate the lance longitudinally. The Scotch yoke mechanism, which is contained in an accessory housing attached to the side of the carriage, drives the solid internal shaft, which is geared to the hub of the lance to oscillate the latter.

4 Claims, 7 Drawing Figures

FIG. 1.
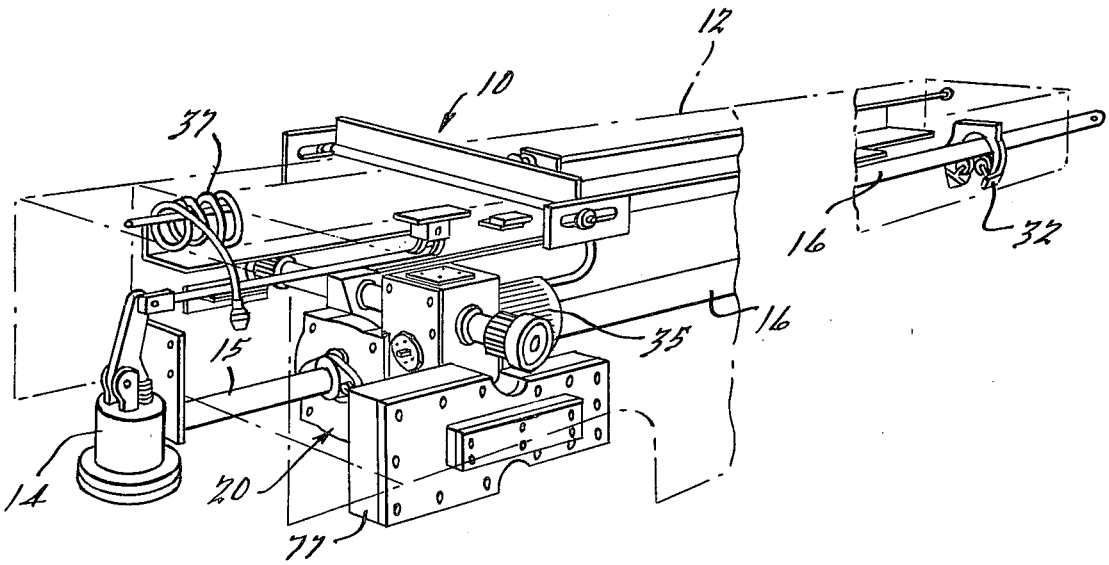
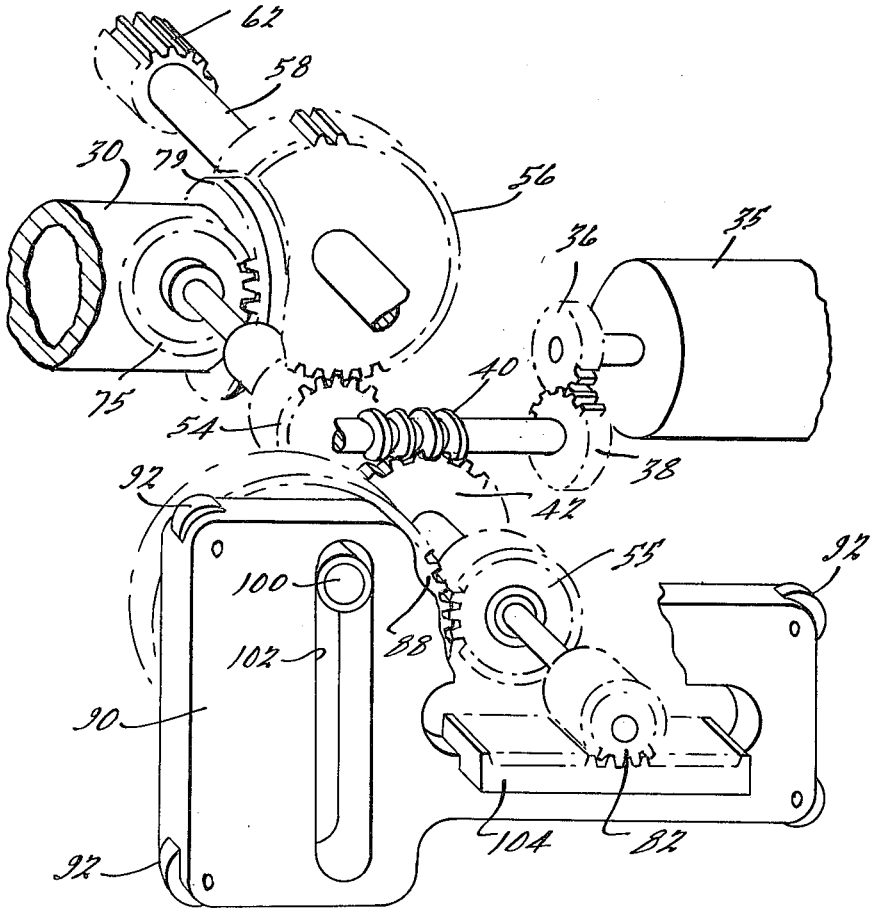
FIG. 7.

IV
IV
12
24
26
28
65
62
30
58
75
52
46
54
56
70
40
42
74
80
48
44
50
45
55
64
60
77
82
108
110
25
12
21
24

30
79
75
20
54
38
40
70
77

OSCILLATING SOOT BLOWER MECHANISM

BACKGROUND OF THE INVENTION

Retractable soot blowers (which term includes so-called water lances) must sometimes be installed close to walls or other parts which could be eroded or otherwise damaged by the jet from the blower. In order to prevent such impingement it is desirable to establish a pattern of travel for the blower nozzle such that rotary motion of the lance is confined to a specifically limited angle and to a predetermined angular position. It is also desirable to similarly restrict the angular pattern of the lance under conditions such that portions of the full 360 degree possible pattern would not cause the jet to impinge any cleanable area.

In the past some constructions have been employed which although permitting full 360 degree rotation of the lance, interrupt the feed of blowing medium during a desired portion of the rotation. This is not feasible under the high temperatures imposed on the lance in many modern installations, because of damage which the lance would suffer if the cooling effect of blowing medium were interrupted while the lance is in the boiler.

Although various constructions have been devised heretofore for limiting the angular travel of rotary blowers, these have not been of a character which would permit simple adaptation thereof to standard types of long retracting blowers.

It is accordingly an object of the present invention to provide improved accessory transmission means for a standard type of blower which limits the angular blast pattern to a predetermined path, which means is so designed that no substantial modifications of the standardized blower construction are required. The efficiency of the boiler and safety of personnel are safeguarded by the fact that this invention permits use of standard soot blower components of proven design, while the cost of providing the limited angular pattern feature is minimized.

Other objects and advantages of this invention will become apparent to those skilled in the art upon consideration of the present disclosure in its entirety.

BRIEF DESCRIPTION OF THE FIGURES OF DRAWING

FIG. 1 is a perspective view, partly broken away, of a soot blower incorporating the transmission means of the present invention.

FIG. 3 is a cross-sectional view on a larger scale taken substantially on the line III—III of FIG. 2 and looking in the direction of the arrows.

FIG. 7 is a diagrammatic perspective view of the principal components of the gearing and yoke system for driving the carriage and lance tube.

DETAILED DESCRIPTION OF PREFERRED FORM OF THE INVENTION

Figure 2:
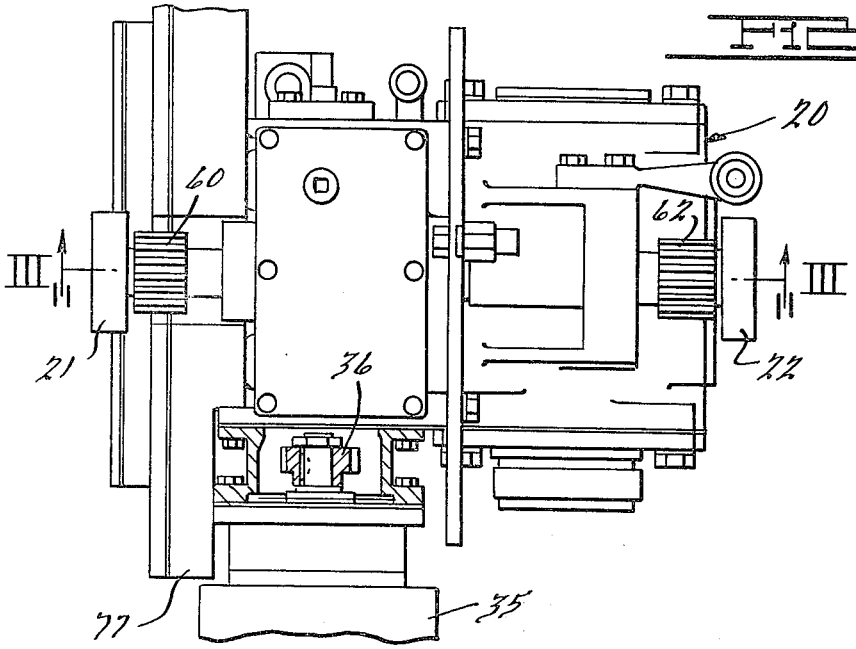
FIG. 2 is a top plan view of the carriage and adjacent parts.

Reference character 10 designates generally a soot blower of the so-called "IK" long travel type. The general construction of the soot blower corresponds to the disclosure of Nelson et al U.S. Pat. No. 3,439,376, although the disclosure of said patent includes a showing of a contoured rail structure and supplemental supporting means for preventing undue sagging of the lance tube and of the feed tube, which features are only required where the blower is of great length, so that sagging of these components becomes a problem. In blowers which are not designed for such extreme extension, the beam and tracks are typically made straight, as shown in FIG. 1 hereof. In FIG. 1 the beam structure, which is basically in the form of an inverted U channel, is not illustrated but its position is indicated at 12 in broken lines. The blower, as is conventional, includes a blow valve 14 supported at the rear end of the beam and to which is attached a fixed feed tube 15. The lance tube 16, which is slidably overfitted on the feed tube 15 is secured at its rear end to a hub 30 rotatable in the carriage 20. The carriage is supported in the beam to travel therealong on rollers 21, 22. The rollers are confined between lower and upper track elements 24, 25 and 26, 28 secured to the inner sidewalls of the beam. The lance tube, which is thus rotatable about its longitudinal axis as well as actuatable longitudinally by the carriage, is supported at its forward end adjacent the wall box (not shown) at the boiler wall, by means of a pair of rollers mounted in a roller bracket assembly 32 attached to the forward end of the beam 12, to control the path of the lance into and out of the boiler setting (not shown).

A motor 35 is secured to the forward wall of the carriage housing 20 and receives power through a flexible conductor assembly 37. The motor drives, through a pair of spur gears 36, 38, a worm 40 which drives a worm wheel 42 fast on a tubular idler shaft 44 journaled as by means of bearings 45, 46 on an internal shaft 48, such interfitted shafts being rotatably supported transversely of the carriage in antifriction bearing assemblies 50, 52. The concentric interfitted shafts 44, 48, the gears, bearings, etc. carried thereby and parts to be described contained in an accessory housing assembly 77, 108, 110, comprise a unitized conversion or accessory transmission assembly. The radially outer tubular idler shaft 44 carries fast thereon, in addition to worm wheel 42, a pinion 54 and a spur gear 55. Pinion 54 meshes with a gear 56 fast on a cross shaft 58 rotatably supported near the top of the carriage and extending transversely thereof and outwardly therefrom to carry at its outer extremities the rollers 21, 22. Adjacent each roller is a pinion 60, 62 fast on the shaft 58. The pinions 60, 62 mesh with racks 64, 65 secured to the undersides of the upper track portions 25, 28 and act as walking pinions to drive the carriage along the beam, in the known manner.

Figure 5:
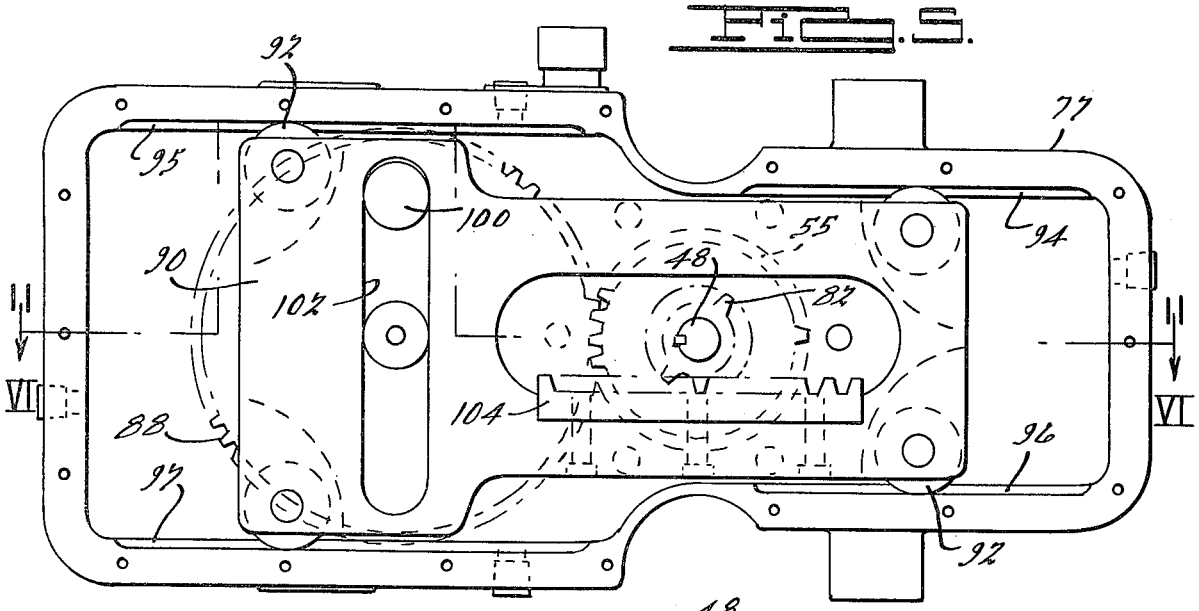
FIG. 5 is a side elevational view of the accessory housing, with the cover removed.
Figure 6:
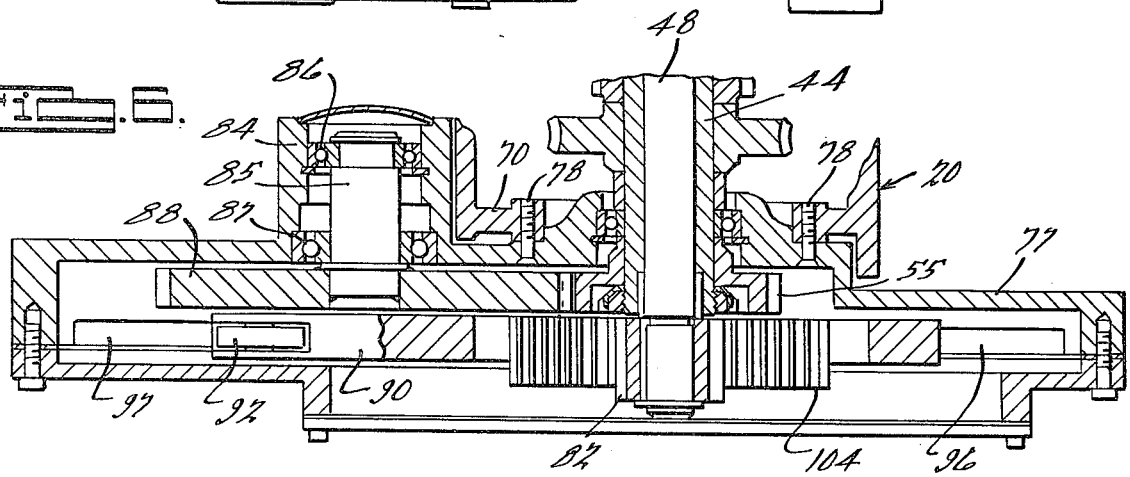
FIG. 6 is a sectional plan view corresponding to a cross-section taken substantially on the line VI—VI of FIG. 5 and looking in the direction of the arrows, showing the cover in place
Figure 2:
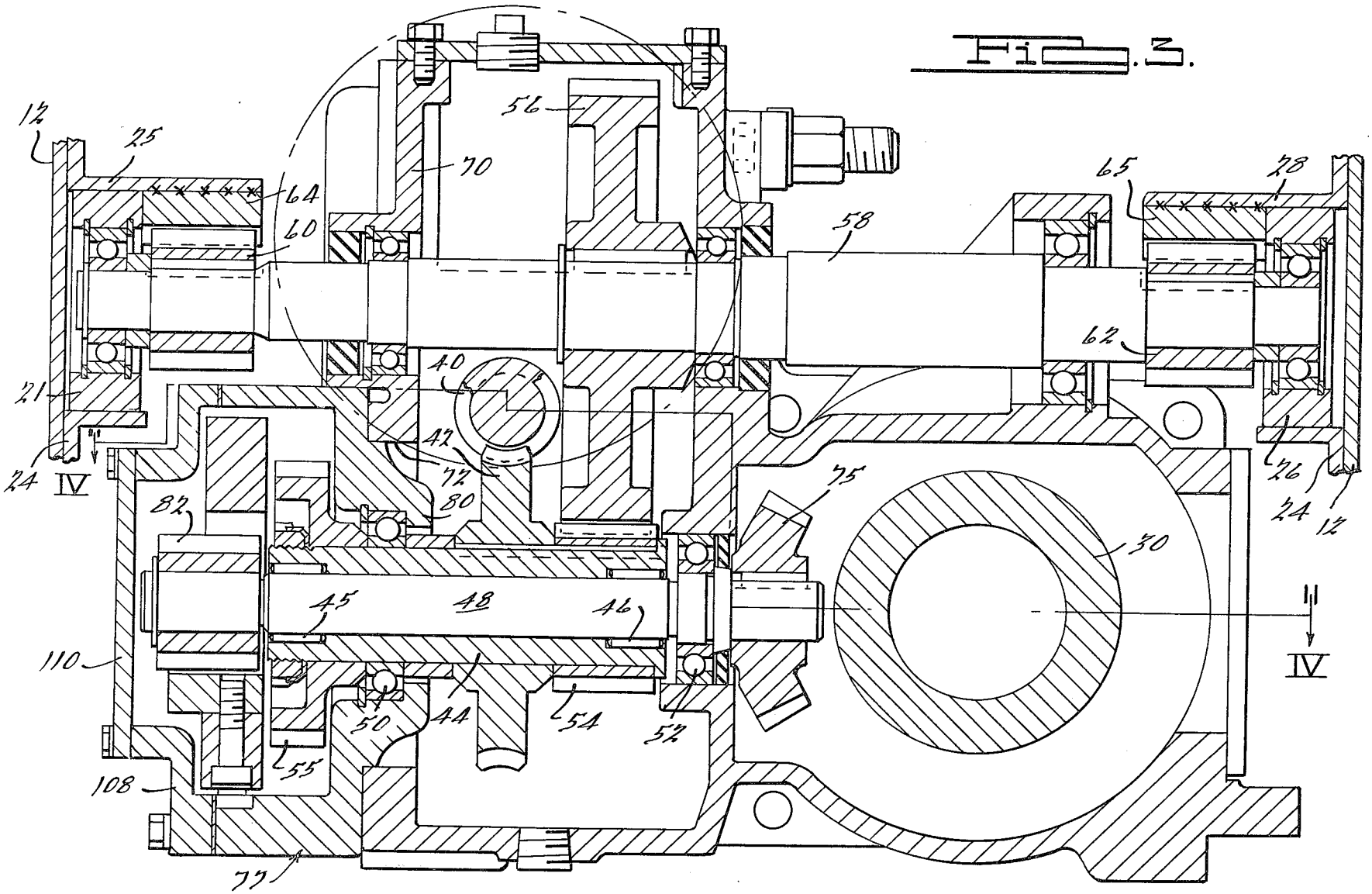
Figure 4:
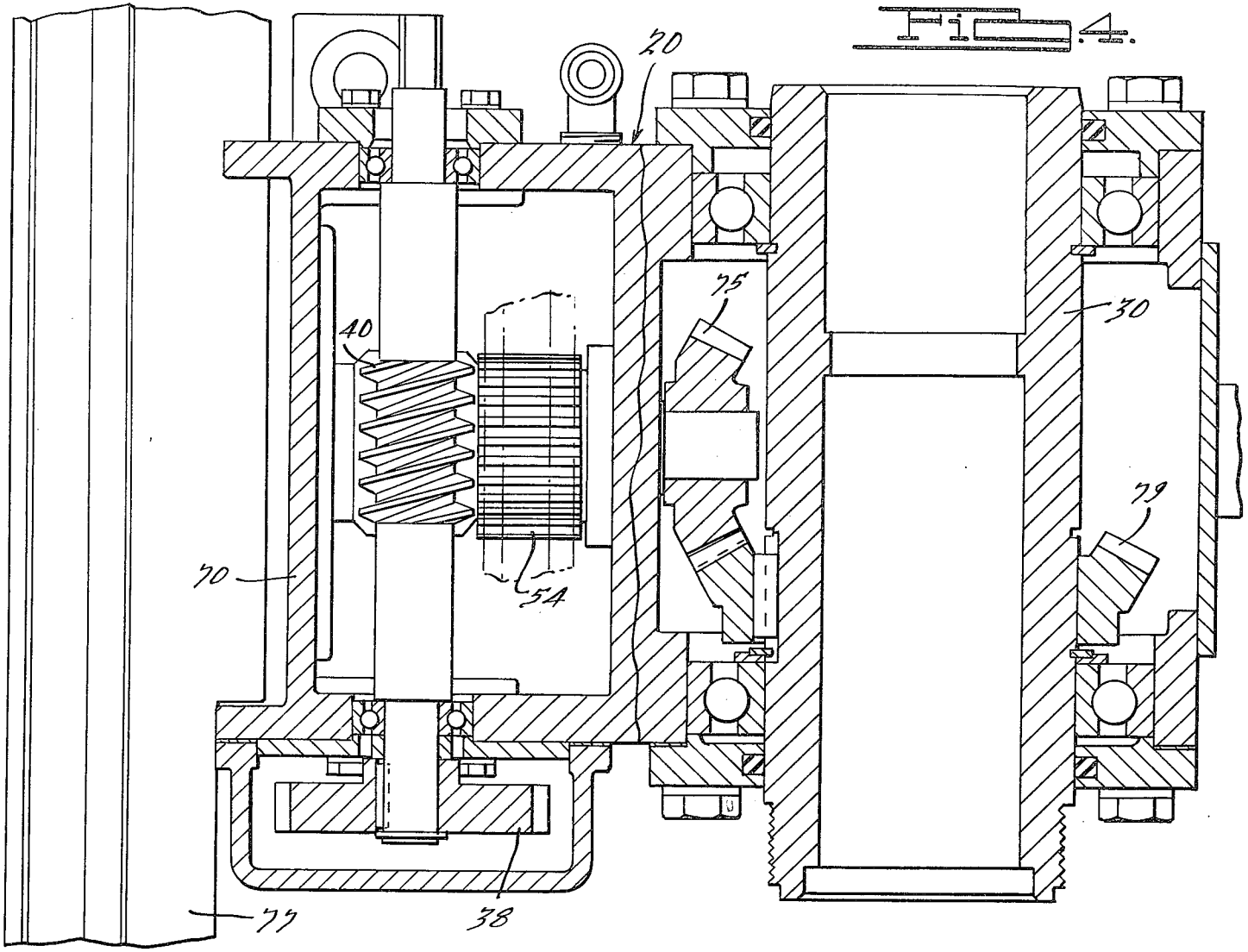
FIG. 4 is a sectional plan view taken substantially on the line IV—IV of FIG. 3 and looking in the direction of the arrows.

In a conventional soot blower which the present invention is designed to modify, a single solid shaft positioned correspondingly to but shorter than the shaft 48 carries fast thereon gears corresponding to the gears 42 and 54, and also carries at its inner end a bevel gear corresponding to the gear 75 which imparts rotary drive to the hub 30 and thereby to the lance. Thus in the conventional or unmodified blower the rotation of such solid shaft corresponding to the shaft 48 imparts continuous longitudinal motion to the carriage and lance via the gear 56, and continuous rotary motion to the lance via the bevel gears 75, 79. In the modified construction incorporating the conversion unit of the present invention, however, the concentric shafts 44, 48 project outside the carriage housing through the concentric opening 72 in the side wall 70 of the carriage, and into the accessory housing portion 77 secured to the wall 70. A boss 80 integral with housing portion 77 is accurately piloted in the opening 72 and housing portion 77 is secured to the wall 70 by machine screws 78 engaged in tapped holes (undesignated) in the wall 70 which normally receive the screws for securance of the combined closure and bearing support employed in the unmodified blower construction to carry the aforementioned single solid shaft. (In this connection reference may be made to FIGS. 4 and 5 of the drawing of U.S. Pat. No. 3,439,376.)

Directly behind and close to the rear wall of the carriage housing 20 and in alignment with the interfitted shafts 44, 48 the housing portion 77 is provided with an integral bearing boss 84 within which a stub shaft 85 is journaled in suitable antifriction bearings 86, 87. Stub shaft 85 carries within the housing portion 77 a yoke gear 88 meshing with and drivable by the gear 55 which is mounted on the outer end of shaft 44 within housing portion 77. Shaft portion 48 projects beyond the tubular shaft 44 at the outer end and carries fast thereon the yoke driven gear 82. Yoke member 90 is reciprocably mounted in housing portion 77 by means of suitable rollers as 92 engaging track portions 94, 95, 96, 97 carried by the inner surfaces of the upper and lower walls of housing portion 77. A crank pin 100 fast in the gear 88 engages in the yoke slot 102 to actuate the yoke. A rack element 104 secured to the yoke meshes with pinion 82 to oscillate the shaft 48 and pinion 75. The open outer face of the housing portion 77 is closed by a two-part cover comprising a main cover portion 108 and a separately removable access plate 110.

It will be seen that when the motor imparts a continuous rotary drive to tubular shaft 44 via worm and worm wheel 40, 42, a continuous drive is imparted to the carriage through the gears 54, 56 and walking pinions 60, 62, and at the same time, reciprocation of the yoke imparts an oscillatory motion to the shaft 48, thereby oscillating the lance about its longitudinal axis through a predetermined angle. The angular motion imparted to the lance is variable by changing the position of installation of the crank pin 100.

Conventional blowers are adapted to be modified in a simple manner to provide for oscillation of the lance, which work can be performed in the field if necessary, simple by removing the conventional shaft and gear assembly from the position corresponding to that in which the interfitted shafts 44, 48 are shown in the present disclosure, and substituting the hereindisclosed conversion transmission assembly.

This Detailed Description of the preferred form of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

While preferred embodiments of the invention have been described herein, it will be appreciated that various modifications and changes may be made without departing from the spirit and scope of the appended claims.

What is claimed is:

1. In a long travel soot blower or the like having a supporting beam, a carriage adapted to travel along the beam and including a housing forming an enclosure for the carriage, a lance secured to the carriage to travel therewith but rotatable about its longitudinal axis, longitudinal rack means carried by the beam, a motor operatively interconnected with the carriage, walking pinion means carried by the carriage and rotatable to drive the carriage and lance along the beam, and transmission means for rotating the walking pinion means and for oscillating the lance about its longitudinal axis characterized by a pair of interfitted independently rotatable shafts journaled in but projecting at their outer ends outside said housing of the carriage, the radially outer of said shafts being drivable by the motor and having gear means thereon within the carriage housing for driving said walking pinion means to actuate the carriage along the beam, a yoke driving gear on the projecting outer end of said radially outer shaft, the outer end of the radially inner shaft extending beyond the outer end of the radially outer shaft, an inner end of said radially inner shaft having a rotary driving connection to the lance within the carriage housing, a yoke driven gear on the outer end of the radially inner shaft, an accessory housing secured to the outside of the carriage housing and enclosing said two last-mentioned gears, and yoke means in said accessory housing actuatable by the yoke driving gear for oscillating the yoke driven gear and the radially inner shaft to oscillate the lance about its longitudinal axis.

2. Transmission means as defined in claim 1 wherein said interfitted shafts are journaled near their outer ends in the accessory housing and journaled near their inner ends in the carriage housing.

3. Transmission means as defined in claim 2 wherein said accessory housing has a boss portion which is piloted in said carriage housing, the outer ends of said interfitted shafts being journaled in said boss portion.

4. Transmission means as defined in claim 1 wherein the yoke means includes a yoke member reciprocably drivable by the yoke driving gear within the accessory housing, and a rack carried by the yoke member meshing with the yoke driven gear.

* * * * *